US007443307B1

(12) United States Patent
Porpora

(10) Patent No.: US 7,443,307 B1
(45) Date of Patent: Oct. 28, 2008

(54) CHRISTMAS TREE ORNAMENT HAZARD DETECTOR

(76) Inventor: Philip Porpora, 38 Greenridge Dr., Brookfield, CT (US) 06804

( * ) Notice: Subject to any disclaimer, the term of this patent is extended or adjusted under 35 U.S.C. 154(b) by 219 days.

(21) Appl. No.: 11/472,103

(22) Filed: Jun. 21, 2006

(51) Int. Cl.
*G08B 17/10* (2006.01)

(52) U.S. Cl. ..... 340/628; 340/629

(58) Field of Classification Search ..... 340/628, 340/629, 693.5, 693.6, 691.1; 169/61
See application file for complete search history.

(56) References Cited

U.S. PATENT DOCUMENTS

| | | | | |
|---|---|---|---|---|
| 3,806,921 | A | 4/1974 | Pappas | |
| 4,075,614 | A | 2/1978 | White | |
| D252,862 | S | 9/1979 | Mackay | |
| 4,623,878 | A | 11/1986 | Schoenwetter | |
| 5,031,702 | A * | 7/1991 | Trumbach | 169/61 |
| 5,396,221 | A | 3/1995 | Bridges | |
| 5,625,345 | A | 4/1997 | Stark et al. | |
| 5,821,865 | A | 10/1998 | Solak | |
| D404,669 | S * | 1/1999 | Welter et al. | D10/106 |
| 6,021,852 | A * | 2/2000 | Barnett et al. | 169/58 |
| 6,075,447 | A * | 6/2000 | Nightingale et al. | 340/628 |
| 6,087,946 | A * | 7/2000 | Menard, Jr. | 340/628 |
| 6,384,732 | B1 * | 5/2002 | Schumer | 340/629 |
| 6,512,460 | B1 * | 1/2003 | Prechel et al. | 340/629 |
| 7,283,058 | B2 * | 10/2007 | Kisner et al. | 340/628 |

* cited by examiner

*Primary Examiner*—John A Tweel, Jr.
(74) *Attorney, Agent, or Firm*—Lawrence J. Gibney, Jr.

(57) ABSTRACT

This is a Christmas tree ornament that will alert a homeowner or business owner to the presence of excessive amounts of smoke or heat and sound an alarm. In order for the device to be relatively hidden on the tree, an ornament such as an angel may be placed on top of the device.

3 Claims, 4 Drawing Sheets

CHRISTMAS TREE ORNAMENT HAZARD DETECTOR

BACKGROUND OF THE INVENTION

A. Field of the Invention

This relates to Christmas ornaments and in particular Christmas ornaments that also serve as a fire and smoke detector.

B. Prior Art

There are other prior art references related to hazard detection specifically as it relates to Christmas ornaments. A representative example of this type of device can be found at Solak, U.S. Pat. No. 5,821,865. In the Solak application a smoke or heat detector in the form of a Christmas tree ornament sends a signal to a remote receiver upon detection of smoke or heat in the lower portion of the tree. The remote receiver then energizes an alarm circuit and sounds an appropriate alarm. In the present application, this is an all-in-one unit that detects the smoke or heat and also sounds the alarm; the present application does not employ an independent receiver.

Another example in the prior art can be found at Schoenwetter, U.S. Pat. No. 4,623,878, which is a smoke alarm mounted atop a Christmas tree. A built-in ionization chamber is contained within the cavity of the ornament and again sends a signal to a remote location. Another example in the prior art is found at Bridges, U.S. Pat. No. 5,396,221.

The current device is different in certain material respects to the prior art and specifically using a heat or smoke detector with an audible alarm system built into the ornament.

BRIEF SUMMARY OF THE INVENTION

It is sometimes quite helpful and quite necessary to be able to detect a fire around a Christmas tree. Christmas trees oftentimes are extremely flammable, particularly after a long period of standing. The long period of standing, of course, produces drying out of the tree, which makes for an excellent combustible material.

The current device is mounted on the top of a Christmas tree. On the bottom end is a cone, which fits over the top of the tree. On the top end of the device is a cone on which an ornament—such as a star—could rest. In the middle of the device is a casing that contains a power supply, a controller, a smoke and heat detector and appropriate wiring. Additionally, a series of vent holes are contained on the bottom surface of the casing so that it is easier for the device to detect heat and smoke, as the smoke and heat travel upward and pass trough the vent holes of the device.

The alarm feature of the device is likely to be actuated by a certain amount of preset variables that may be set by the manufacturer or by the consumer. A controller, which is housed in the casing, is provided to trigger the alarm features of this device.

Additionally, an electrical outlet is provided for power. A battery backup in the event of electrical failure is also provided.

Because this is a tree ornament and will be displayed around a Christmas tree, it should be aesthetically pleasing to the consumer as well as serving the function of being able to mount an ornament on the top of the tree.

DETAILED DESCRIPTION OF THE EMBODIMENTS

Figure 1:
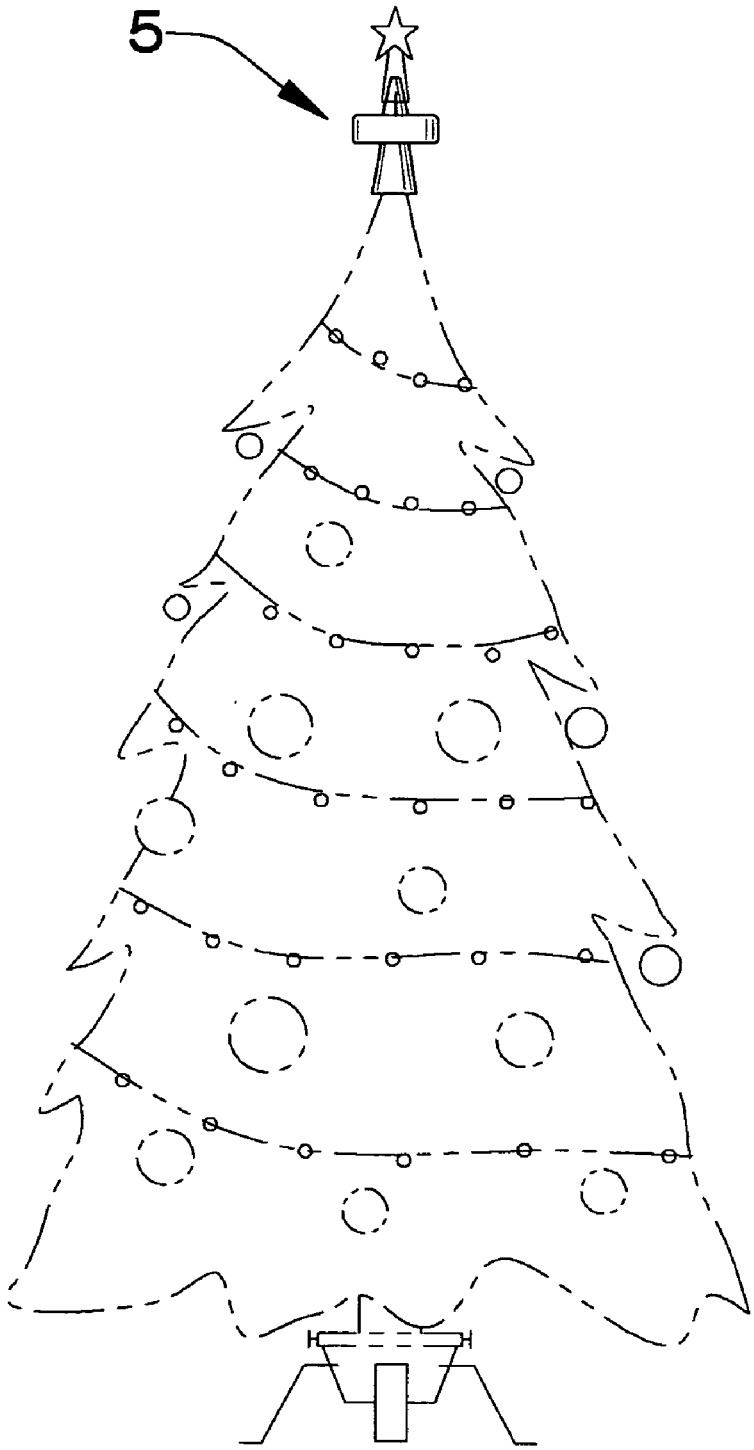
FIG. 1 is a front view of the device mounted on the top of a tree.
Figure 2:
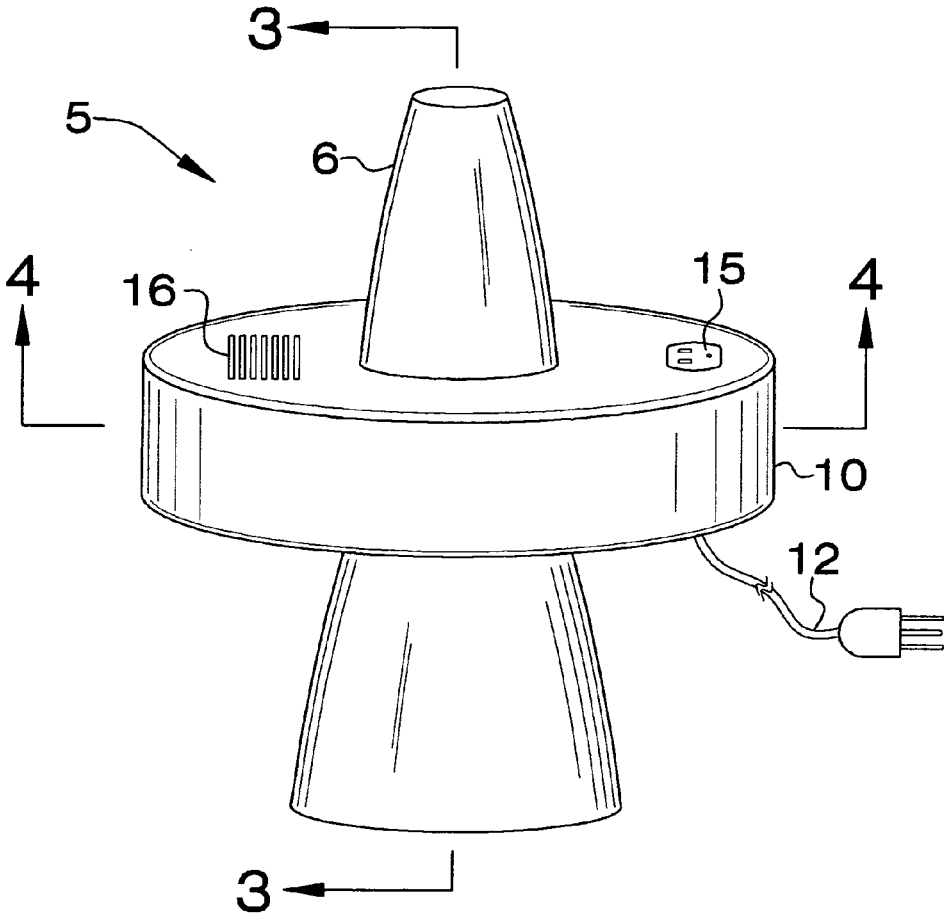
FIG. 2 is a front view of the device not on the tree.
Figure 3:
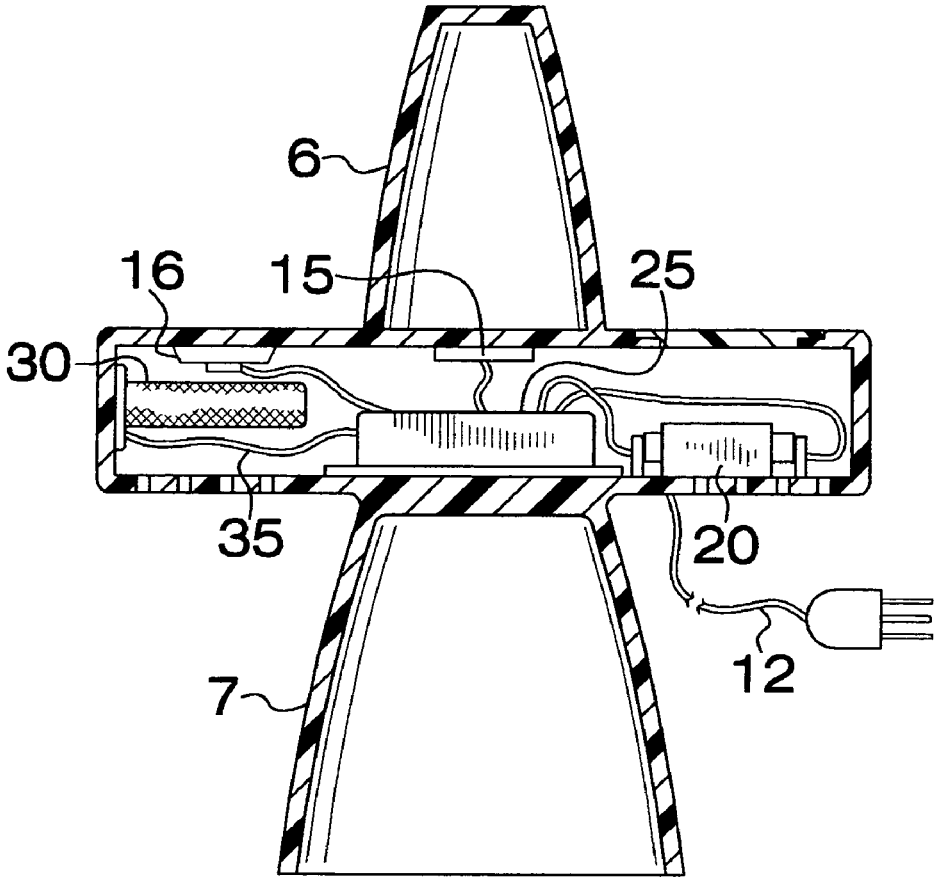
FIG. 3 is a view according to line 3-3 on FIG. 1.
Figure 4:
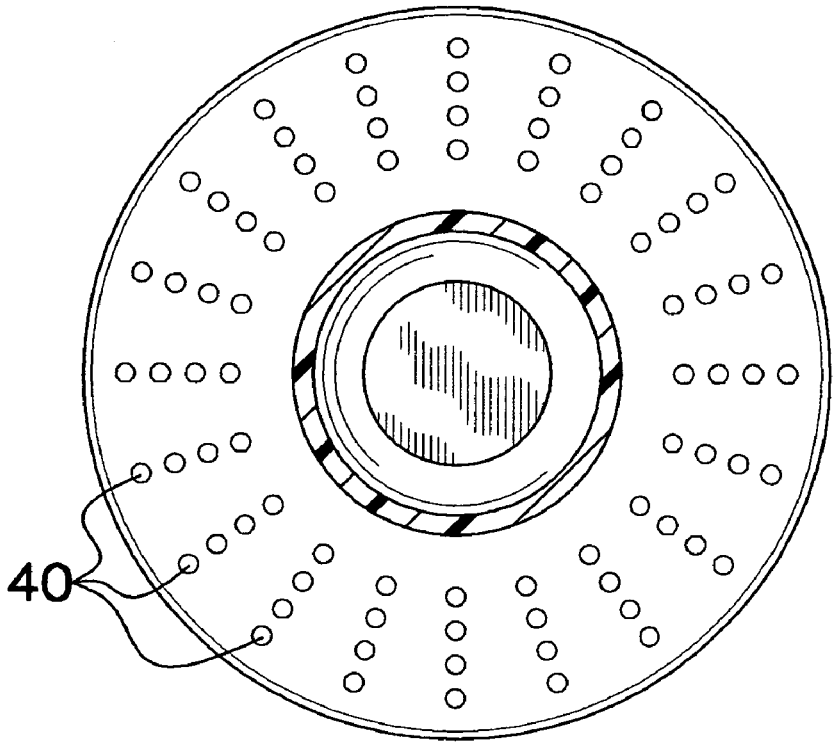
FIG. 4 is a view according to line 4-4 on FIG. 1.

This is a Christmas tree ornament hazard detector. The device 5 will have a bottom cone 7 as well as a top cone 6. A casing 10 between the two cones will be provided. The bottom cone 7 is hollow and can be inserted over the top of the tree. The top cone 6 can either be solid or hollow. The top interior surface of the bottom cone will be solid and the bottom interior surface of the top cone will also be solid such as depicted in FIG. 3.

A Christmas tree ornament such as a star can be mounted over the top cone 6. On the bottom surface of the casing is a plurality of vent holes 40. The purpose of the vent holes 40 is to ensure that enough air is circulated throughout the device so that the device can detect the presence of smoke and/or heat. A smoke and/or heat detector 30 is installed within the interior of the casing 10 that is hollow. Additionally, a power supply 20 as well as a controller 25 and wiring 35 are also installed within the casing 10. On the outside of the casing will be an electrical outlet 15 as well as a power cord 12. The outlet 15 enables the user to plug this device into the existing Christmas tree lighting. A battery backup will also be provided in the event of a power failure.

Additionally, a speaker 16 that will emit a loud audible signal in the event of the presence of excess heat or smoke will also be provided.

While the embodiments of the invention have been disclosed, certain modifications may be made by those skilled in the art to modify the invention without departing from the spirit of the invention.

The inventor claims:

1. A Christmas tree ornament hazard detector, which is comprised of:

a. a bottom cone;
- wherein the bottom cone has a first and a second end;
- wherein the bottom cone is hollow;
- wherein the top surface of the interior of the bottom cone is solid;
- wherein the bottom cone is placed over the top branch of the tree;
- wherein the bottom cone is joined to the bottom surface of a casing;

b. the casing;
- said casing is joined to the bottom cone;
- said casing is hollow;

c. a top cone;
- wherein the top cone is joined to the top surface of the casing;
- wherein the bottom interior surface of the top cone is solid;
- wherein the top cone allows an ornament to be inserted over it;

d. power supply;
- wherein a power supply is provided;

e. a controller;
- wherein a controller is provided;

f. a smoke and heat detector;

wherein a smoke and heat detector is inserted in the casing;

said smoke and heat detector is activated by the controller;

g. vent holes;

wherein a plurality of vent holes is provided on the bottom surface of the casing around the entire perimeter of the bottom surface of the casing;

h. speaker;

wherein a speaker is provided;

said speaker is activated by the controller.

2. The device as described in claim 1 wherein the power supply is alternating current.

3. The device as described in claim 1 wherein the power supply is a battery.

* * * * *